US007290513B2

(12) United States Patent
Heintzen et al.

(10) Patent No.: US 7,290,513 B2
(45) Date of Patent: Nov. 6, 2007

(54) DEVICE FOR CHANGING THE CONTROL TIMES OF GAS EXCHANGE VALVES IN AN INTERNAL COMBUSTION ENGINE, IN PARTICULAR, A ROTATING PISTON ADJUSTMENT DEVICE FOR ANGULAR ADJUSTMENT OF A CAMSHAFT RELATIVE TO A CRANKSHAFT

(75) Inventors: Dirk Heintzen, Weisendorf (DE); Rudolf Eydam, Geisfeld (DE)

(73) Assignee: Schaeffler KG, Herzogenaurach (DE)

( * ) Notice: Subject to any disclaimer, the term of this patent is extended or adjusted under 35 U.S.C. 154(b) by 22 days.

(21) Appl. No.: 10/575,143

(22) PCT Filed: Oct. 20, 2004

(86) PCT No.: PCT/EP2004/011850

§ 371 (c)(1),
(2), (4) Date: Apr. 10, 2006

(87) PCT Pub. No.: WO2005/061860

PCT Pub. Date: Jul. 7, 2005

(65) Prior Publication Data

US 2007/0039580 A1 Feb. 22, 2007

(30) Foreign Application Priority Data

Nov. 27, 2003 (DE) ..... 103 55 502

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,405,694 B2 * 6/2002 Sato ..... 123/90.15
2001/0054406 A1 12/2001 Okada et al.
2002/0078913 A1 6/2002 Fukuhara et al.

FOREIGN PATENT DOCUMENTS

| | | |
|---|---|---|
| DE | 101 01 328 | 12/2001 |
| DE | 101 33 445 | 7/2002 |
| DE | 101 50 856 | 4/2003 |
| DE | 102 46 838 | 4/2004 |
| DE | 102 53 883 | 5/2004 |
| JP | 2000179310 | 6/2000 |

* cited by examiner

*Primary Examiner*—Zelalem Eshete
(74) *Attorney, Agent, or Firm*—Volpe and Koenig, P.C.

(57) ABSTRACT

A device for changing the control times of gas-exchange valves in an internal combustion engine is provided, which includes a drive wheel (2) in driven connection with the crankshaft and a vane rotor (3) fixed with the camshaft. The drive wheel (2) has a hollow space, which is formed by a hollow cylindrical peripheral wall (4) and two lateral walls (5, 6), in which at least one hydraulic work chamber (9) is formed by at least two radial limit walls (7, 8), which is divided by at least one vane (11) into an A pressure chamber (12) and a B pressure chamber (13). The vane rotor (3) can be coupled mechanically with the drive wheel (2) by a separate locking element (14), that can be moved into a locked position within a receptacle (19) in the lateral walls (5) of the drive wheel (2). The receptacle (19) is connected hydraulically to the A pressure chamber (12) via a pressure medium supply groove (18) provided in an inner surface of the lateral wall (5), so that upon pressurization of the A pressure chamber (12), the locking element (14) can move hydraulically into an unlocked position in the rotor hub (10) of the vane rotor (3). According to the invention, a local stop (20) is arranged within the pressure medium supply groove (18) in the inner surface of the lateral wall (5), through which a pressure medium supply to the receptacle (19) of the locking element (14) is possible only through a bypass (21) when the vane rotor (3) is in the base position.

3 Claims, 3 Drawing Sheets

DEVICE FOR CHANGING THE CONTROL TIMES OF GAS EXCHANGE VALVES IN AN INTERNAL COMBUSTION ENGINE, IN PARTICULAR, A ROTATING PISTON ADJUSTMENT DEVICE FOR ANGULAR ADJUSTMENT OF A CAMSHAFT RELATIVE TO A CRANKSHAFT

BACKGROUND

The invention relates to a device for changing control times for gas-exchange valves in an internal combustion engine according to features recited in the preamble of claim 1, which can be realized especially advantageously on a rotary piston adjustment device for angular adjustment of a camshaft relative to a crankshaft.

From DE 101 50 856 A1, a class-defining device for changing control times of gas-exchange valves in an internal combustion engine is known, which is mounted on the drive end of a camshaft supported in the cylinder head of an internal combustion engine and which, in principle, is embodied as a hydraulic actuator that can be controlled as a function of various operating parameters of the internal combustion engine. This device essentially consists of a drive wheel, in driven connection with the crankshaft of the internal combustion engine, and of a vane rotor, which is locked in rotation with the camshaft of the internal combustion engine. The drive wheel and vane rotor are in force-transmitting connection with each other and transmit the torque of the crankshaft to the camshaft of the internal combustion engine. The drive wheel has a hollow space, which is formed by a hollow cylindrical peripheral wall and two lateral walls and in which five hydraulic work chambers are formed by five radial limit walls which extend towards the longitudinal center axis of the device. Correspondingly, on the periphery of its rotor hub, the vane rotor has five vanes, which extend radially into the work chambers and which sub-divide the work chambers into an A pressure chamber and a B pressure chamber, which can be used to cause a pivoting motion or to fix the vane rotor relative to the drive wheel and thus the camshaft relative to the crankshaft through selective or simultaneous pressurization with a hydraulic pressure medium. In addition, the vane rotor can be mechanically coupled to the drive wheel by a separate locking element in a preferred base position within its adjustment region when the pressure medium pressure falls below a pressure necessary for adjustment, such as, for example, when the internal combustion engine is turned off, in order to prevent rattling of the vane rotor striking the limit walls of the drive wheel due to the changing torque of the camshaft, especially when the internal combustion engine is restarted and until the necessary pressure medium pressure has been established. This locking element, embodied as a sleeve-like cylinder pin, is arranged in a continuous axial bore hole in the rotor hub of the vane rotor and can move into a locked position within a receptacle in the lateral wall of the drive wheel facing away from the camshaft by a spring element, which is provided as a compression coil spring and which is supported on one side on the rear side of the locking element and on the other side on a holder similarly inserted into the axial bore hole. The receptacle of the locking element is connected to one of the A pressure chambers of the device via a pressure medium supply groove machined into the inner surface of the lateral wall facing away from the camshaft, so that when the A pressure chambers have been pressurized, the locking element can move hydraulically into an unlocked position within the axial bore hole in the rotor hub of the vane rotor.

However, a disadvantage in this known device is that the locking element is in constant pressure medium connection with the corresponding A pressure chamber of the device for mechanical coupling of the vane rotor with the drive wheel in its unlocked position also outside of the base position of the vane rotor via the pressure medium supply groove to its receptacle in the lateral wall of the drive wheel, so that when the A pressure chambers are pressurized, the applied pressure medium pressure and also the resulting pressure peaks of the pressure medium also act permanently on the locking element or on the entire locking mechanism. Because the pressurized locking element is supported on its holder arranged in the axial bore hole of the rotor hub and the usually plastic holder is supported on its side on the lateral wall of the drive wheel facing the camshaft and closing the axial bore hole, the pressure medium pressure permanently acting on the locking element leads to increased wear on the holder and on the lateral wall of the drive wheel due to the constant relative rotation between the vane rotor and the drive wheel. However, this wear negatively affects the function of the locking mechanism in a disadvantageous way and can lead to a loss of function over the service life of the device.

SUMMARY

Therefore, the invention is based on the objective of designing a device for changing the control times of gas-exchange valves in an internal combustion engine, especially a rotary piston adjustment device for angular adjustment of a camshaft relative to a crankshaft, in which these disadvantageous effects on the entire locking mechanism resulting from the constant pressure medium connection of the locking element to one of the pressure chambers of the device or from the permanent pressurization of the locking element can be prevented in a simple way.

According to the invention, this objective is met for a device according to the preamble of claim 1, in that within the pressure medium supply groove machined into the inner surface of the appropriate lateral wall of the drive wheel, there is a local stop, by means of which the supply of pressure medium to the receptacle for the locking element is constantly interrupted when the vane rotor has pivoted out of the base position. However, in order to further enable a hydraulic unlocking of the locking element, in the side surface of the vane rotor hub opposite the pressure medium supply groove there is also a bypass, such that the local stop can be bypassed and a supply of pressure medium to the receptacle for the locking element is possible only when the vane rotor is pivoted into the base position.

Here, the locking element is provided as a sleeve-like cylinder pin, which is arranged in a though extending axial bore hole in the rotor hub of the vane rotor and which can move into its locked position in the receptacle in one of the lateral walls of the drive wheel via a spring element, which is provided as a compression coil spring and which is supported on one side on the rear side of the locking element and on the other side on a holder also inserted into the axial bore hole.

Correspondingly, the receptacle for the locking element is provided in a similarly known manner as a local recess in the inner surface of the lateral wall opposite the locking element. This lateral wall has a preferably rectangular outline, which is larger by a defined amount of play than the cross-sectional surface of the locking element. The pressure medium supply groove with a preferably arc-shaped profile opens into this lateral wall.

In a useful improvement of the device according to the invention, the receptacle for the locking element formed in this way and its pressure medium supply groove are preferably arranged in the inner surface of the lateral wall facing away from the camshaft and created in this lateral wall without cutting by stamping, wherein the local stop in the pressure medium supply groove is preferably provided as a material crossbar remaining after the stamping. However, for a correspondingly opposed arrangement of the locking element in the axial bore hole in the rotor hub of the vane rotor, it is also possible to arrange the receptacle for the locking element and its pressure medium supply groove in the lateral wall of the drive wheel facing the camshaft. As an alternative to stamping, it is also possible to produce the receptacle for the locking element and its pressure medium supply groove by milling in the corresponding lateral wall of the drive wheel and here to provide the local stop in the pressure medium supply groove also as a material crossbar that is left behind. In addition, for retrofitting it can be advantageous, especially for devices not constructed according to the invention, to form the local stops through later insertion of a corresponding straight pin into a bore hole within the typically continuous pressure medium supply groove.

Finally, according to the preferred arrangement of the receptacle for the locking element in the lateral wall of the drive wheel facing away from the camshaft, it is also proposed as another useful improvement of the device according to the invention to arrange the bypass for the local stop in the pressure medium supply groove also in the lateral wall of the side surface of the vane rotor hub facing away from the camshaft and to provide this bypass as an elongated hole-like recess. It has proven to be effective in an especially advantageous way to form this elongated hole-like recess along with the typically powder-metallurgical production of the vane rotor hub without further tools in the corresponding side surface of the rotor hub, that is, to form the stamping mold for the vane rotor hub such that absolutely no finishing work on the recess forming the bypass is necessary anymore. Here, it is also possible, naturally especially for the use of other suitable materials for the vane rotor hub or also for the retrofitting of devices not embodied according to the invention, to machine the elongated hole-like recess forming the bypass into the corresponding side surface of the vane rotor hub at a later time by cutting processes, such as, for example, milling. To prevent additional throttling positions for the pressure medium, it is also advantageous to dimension the bypass at least twice as long as the width of the material crossbar forming the local stop in the pressure medium supply groove, while its width and depth have approximately the same width and depth as the pressure medium supply groove in the lateral wall of the drive wheel.

Thus, it is possible with a bypass provided in this way in the side surface of the vane rotor hub to bypass the local stop in the pressure medium supply groove to the receptacle for the locking element in the lateral wall of the drive wheel when the vane rotor of the device has been pivoted into its base position, like, for example when the internal combustion engine is turned off, and when the locking element of the device has been pushed into this position in its receptacle in the lateral wall of the drive wheel. When the pressure chambers of the device, of which one is also connected to the pressure medium supply groove to the receptacle for the locking element, are pressurized, such as, for example, when the internal combustion engine is restarted, the hydraulic pressure medium first reaches the local stop in the pressure medium supply groove and then flows within the bypass into the vane rotor hub past the local stop into the receptacle for the locking element, and then moves the locking element into its unlocked position within the axial bore hole in the vane rotor hub. The vane rotor, which is now unlocked, then pivots out of its base position due to the further pressurization of the pressure chambers, so that the bypass in its rotor hub also moves out of its bypass position for the local stop in the pressure medium supply groove and the continued supply of pressure medium to the receptacle for the locking element is interrupted by the smooth side surface of the vane rotor hub now contacting the local stop.

The device according to the invention for changing the control times of gas-exchange valves in an internal combustion engine, especially a rotary piston adjustment device for angular adjustment of a camshaft relative to a crankshaft, thus features the advantage, in comparison with the devices known from the state of the art, that the locking element for mechanical coupling of the vane rotor with the drive wheel is no longer in pressure medium connection with the correspondingly pressurized pressure chamber of the device outside of the base position of the vane rotor due to the arrangement of a simple local stop in the pressure medium supply groove to its receptacle in the lateral wall of the drive wheel. Through such a local stop, it is thus ruled out in each position of the vane rotor outside of its base position that when the pressure chamber connected to the pressure medium supply groove is pressurized, neither the normally applied pressure of the hydraulic pressure medium nor its pressure peaks exert a negative effect on the locking mechanism. In particular, the holder of the locking element and the lateral wall of the drive wheel supporting the holder no longer experience increased wear, so that their function is reliably guaranteed over the service life of the device. Simultaneously, due to the bypass arranged in the vane rotor hub, it is possible as before for the locking element to be moved hydraulically into its unlocked position in the vane rotor hub in a known way when the vane rotor has been pivoted into its base position.

BRIEF DESCRIPTION OF THE DRAWINGS

The invention is explained in more detail below with reference to one embodiment and is shown schematically in the associated drawings.

Shown are.

DETAILED DESCRIPTION OF THE PREFERRED EMBODIMENTS

Figure 1:
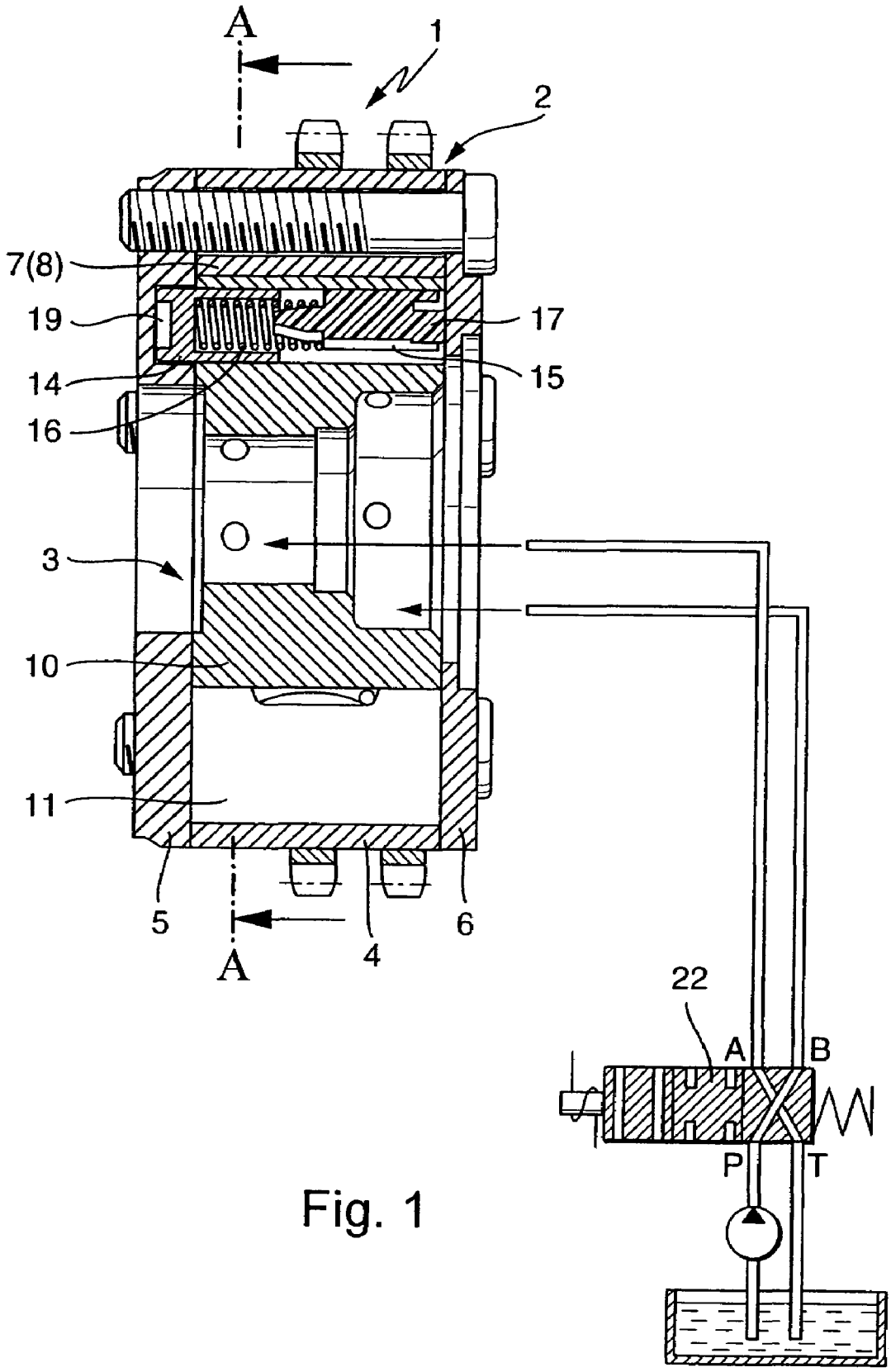
FIG. 1 a cross sectional view through a device according to the invention for changing the control times of gas-exchange valves in an internal combustion engine.

From FIG. 1, a device 1 for changing the control times of gas-exchange valves in an internal combustion engine is clear, which is provided as a rotary piston adjustment device for angular adjustment of a not-shown camshaft relative to a similarly not-shown crankshaft of an internal combustion engine. This device 1 is mounted on the drive end of the camshaft supported in the similarly not shown cylinder head of the internal combustion engine and is constructed, in principle, as a hydraulic actuator, which is controlled by the hydraulic valve designed in FIG. 1 with 22 as a function of various operating parameters of the internal combustion engine.

Figure 4:
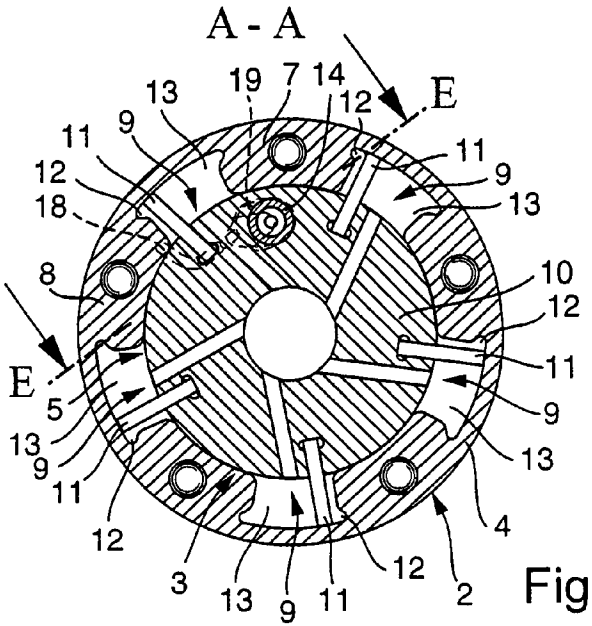
FIG. 4 the section A-A from FIG. 1 through the device according to the invention for a vane rotor pivoted out of the base position by about 5°.
Figure 2:
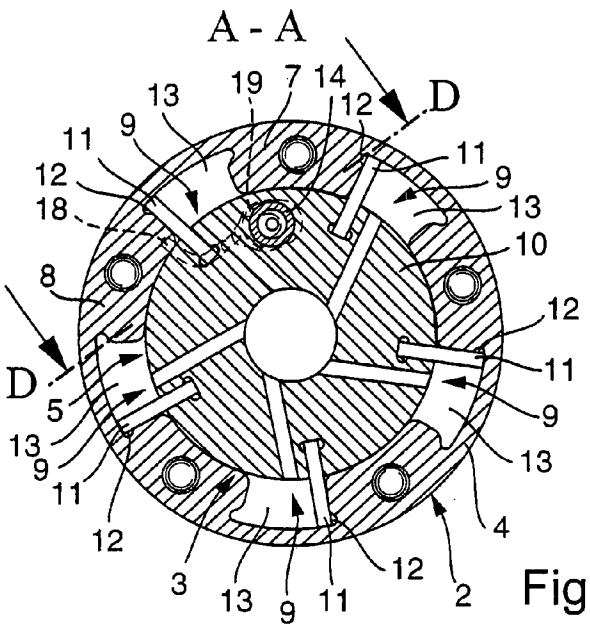
FIG. 2 the section A-A from FIG. 1 through the device according to the invention for a vane rotor pivoted into its base position.

In addition, in FIGS. 1, 2, and 4, it is to be seen that the device 1 essentially includes a drive wheel 2, in driven connection with the crankshaft, and a vane rotor 3, locked in rotation with the camshaft, wherein the vane rotor 3 is supported in the drive wheel 2 so that it can pivot and is in force-transmitting connection with the drive wheel 2. The drive wheel 2 has a hollow space, which is formed by a hollow cylindrical peripheral wall 4 and two lateral walls 5, 6 and in which five hydraulic work chambers 9 uniformly distributed around the periphery are formed by five radial limiting walls 7 and 8 directed towards the longitudinal center axis of the device 1. Correspondingly, the vane rotor 3 has on the periphery of its rotor hub 10 five vanes 11, which are distributed uniformly around the periphery, which each extend into a work chamber 9 of the drive wheel 2, and which each sub-divide the work chambers 9 into an A pressure chamber 12 and a B pressure chamber 13, which can be used to provide a pivoting motion or to fix a position of the vane rotor 3 relative to the drive wheel 2 and thus an angular adjustment or a hydraulic fixing of the camshaft relative to the crankshaft through selective or simultaneous pressurization with a hydraulic pressure medium.

Likewise, it is visible from FIG. 1 that the device 1 has a separate locking element 14, with which the vane rotor 3 can be coupled mechanically with the drive wheel 2 in a preferred base position within its adjustment region when the pressure medium pressure falls below a pressure necessary for adjustment in order to prevent rattling of the vane rotor 3 due to the changing torque of the camshaft when the internal combustion engine is started. This locking element 14, provided as a sleeve-like cylinder pin, can move in a through extending axial bore hole 15 in the rotor hub 10 of the vane rotor 3 by means of a spring element 16, which is provided as a compression coil spring and which is supported on one side on the rear side of the locking element 14 and on the other side on a holder 17 also inserted into the axial bore hole 15, into a locked position shown in FIG. 1 within a receptacle 19 in the lateral wall 5 of the drive wheel 2 facing away from the camshaft. Here, as follows from FIGS. 2, 4, and 6, the receptacle 19 is connected to one of the A pressure chambers 12 of the device 1 via a circular arc-like pressure medium supply groove 18 machined into the inner surface of the lateral wall 5 of the drive wheel 2 facing away from the camshaft, so that when the A pressure chambers 12 are pressurized, the locking element 14 can move into an unlocked position within the axial bore hole 15 in the rotor hub 10 of the vane rotor 3.

Figure 5:
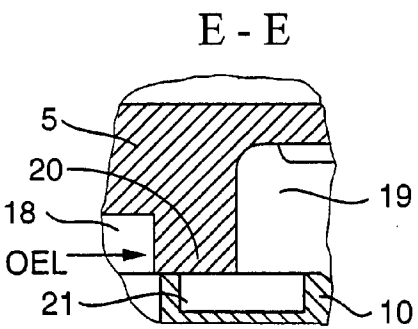
FIG. 5 an enlarged view of section E-E from FIG. 4.
Figure 3:
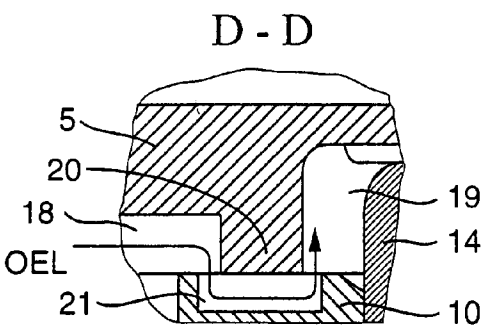
FIG. 3 an enlarged view of section D-D from FIG. 2.
Figure 6:
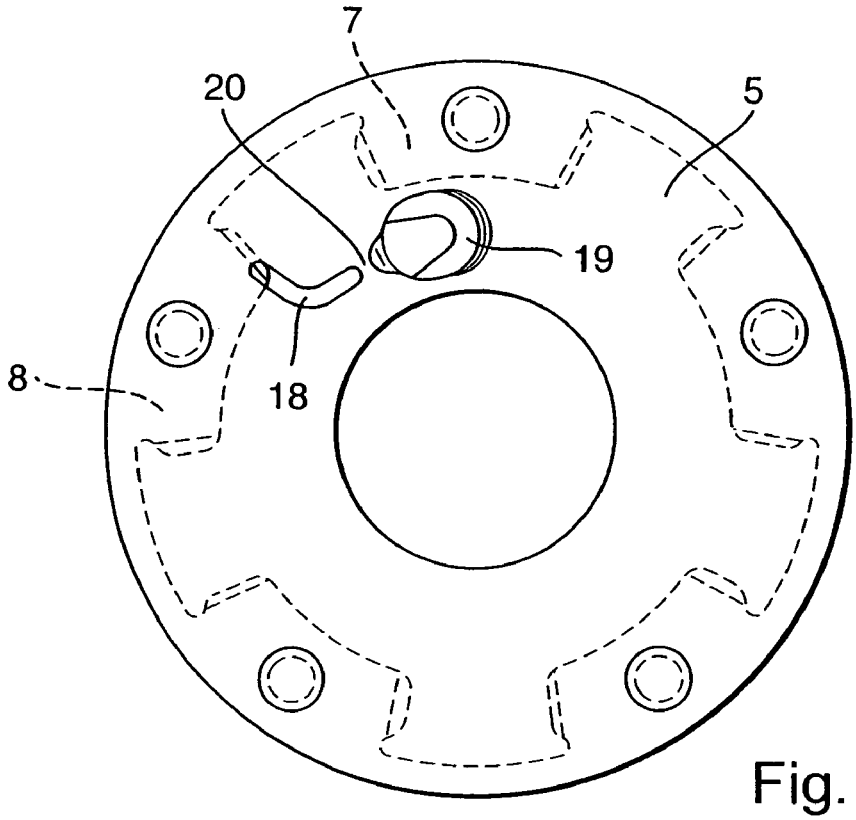
FIG. 6 a top view on the inner surface of the lateral wall of the drive wheel facing away from the camshaft in the device according to the invention.
Figure 7:
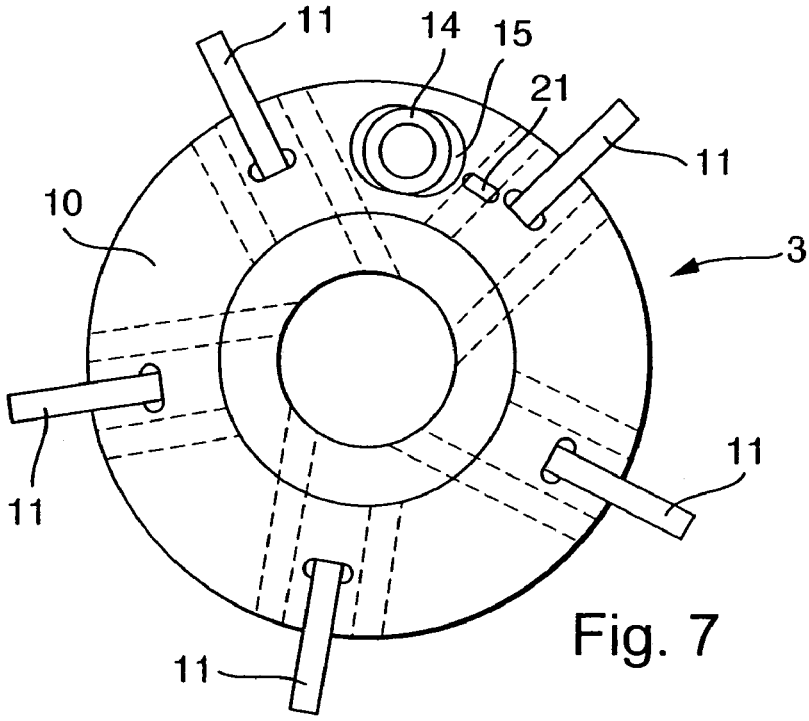
FIG. 7 a top view on the side surface of the vane rotor hub facing away from the camshaft in the device according to the invention.

So that the locking element 14 is not constantly exposed to the applied pressure medium pressure when the A pressure chambers 12 are pressurized, in the device 1 according to the invention a local stop 20 shown clearly in FIG. 6 is also arranged within the pressure medium supply groove 18 machined into the inner surface of the lateral wall 5 of the drive wheel 2, wherein the receptacle 19 of the locking element 14 and its pressure medium supply groove 18 are produced by stamping in the inner surface of the lateral wall, and the local stop 20 is provided as a material crossbar remaining after the stamping. In FIG. 5, it is illustrated that the pressure medium supply to the receptacle 19 of the locking element 14 is constantly interrupted and the pressure medium pressure can exert absolutely no negative effects on the locking element 14 due to the local stop 20 within the pressure medium supply groove 18 when the vane rotor 3 is pivoted out of the base position. However, in order to enable, as before, hydraulic unlocking of the locking element 14 locked in the base position of the vane rotor 3 shown in FIG. 3, a bypass 21, shown in FIG. 7, is arranged in the side surface of the rotor hub 10 of the vane rotor 3 opposite the pressure medium supply groove 18. With this bypass, the local stop 20 can be bypassed and thus pressure medium supply to the receptacle 19 of the locking element 14 is possible only when the vane rotor 3 has been pivoted into its base position. This bypass 21 for the local stop 20 is clearly visible in FIG. 7 as an elongated hole-like recess in the rotor hub 10 of the vane rotor 3 and can be formed during the powder metallurgical production of the rotor hub 10 of the vane rotor 3 without additional tools and moves with the pivoting of the vane rotor 3 out of its base position from its bypass position towards the local stop 20 in the pressure medium supply groove 18.

LIST OF REFERENCE SYMBOLS

1 Device
2 Drive wheel
3 Vane rotor
4 Peripheral wall
5 Lateral wall
6 Lateral wall
7 Defining wall
8 Defining wall
9 Work chamber
10 Rotor hub
11 Vane
12 A pressure chamber
13 B pressure chamber
14 Locking element
15 Axial bore hole
16 Spring element
17 Holder
18 Pressure medium supply groove
19 Receptacle
20 Stop
21 Bypass
22 Hydraulic valve

The invention claimed is:

1. Device for changing the control times of gas-exchange valves in an internal combustion engine, the device comprising: a rotary piston adjustment device for angular adjustment of a camshaft relative to a crankshaft, with the following features:

the device is mounted on a drive end of a camshaft supported in a cylinder head of the internal combustion engine and is a hydraulic actuator, which can be controlled as a function of various operating parameters of the internal combustion engine, the device includes a drive wheel, in driven connection with the crankshaft of the internal combustion engine, and a vane rotor, locked in rotation with the camshaft of the internal combustion engine, the drive wheel has a hollow space, which is formed by a hollow cylindrical peripheral wall and two lateral walls and in which at least one hydraulic work chamber is formed by at least two radial limit walls, the vane rotor has, on a periphery of a rotor hub thereof, at least one vane, which extends radially into the work chamber of the drive wheel and which sub-divides the work chamber into an A pressure chamber and a B pressure chamber, the pressure chambers are adapted to produce a pivoting motion or to fix the vane rotor relative to the drive wheel and thus the camshaft relative to the crankshaft through selective or simultaneous pressurization with a hydraulic pressure medium, the vane rotor is mechanically couplable with the drive wheel in a preferred base position within an adjustment region by a separate locking element when the pressure medium pressure falls below a pressure necessary for adjustment, the locking element is arranged in an axial bore hole in the rotor hub of the vane rotor and can be moved by a spring element into a locked position within a receptacle in one of the lateral walls of the drive wheel, the receptacle for receiving the locking element is connected hydraulically to at least one pressure chamber within the device via a pressure medium supply groove provided in an inner surface of a corresponding one of the lateral walls of the drive wheel, upon pressurization of the pressure chamber with the pressure medium supply groove, the locking element can move hydraulically into an unlocked position within the axial bore hole in the rotor hub of the vane rotor, a local stop is arranged within the pressure medium supply groove provided in the inner surface of the corresponding lateral wall of the drive wheel, which interrupts the pressure medium supply to the receptacle of the locking element when the vane rotor has been pivoted from the base position, in the side surface of the rotor hub of the vane rotor opposite the pressure medium supply groove there is a bypass, such that the local stop can be bypassed and a pressure medium supply to the receptacle of the locking element is possible only when the vane rotor has been pivoted into the base position.

2. Device according to claim 1, wherein the receptacle for the locking element and the pressure medium supply groove are arranged in an inner surface of the lateral wall of the drive wheel facing away from the camshaft and are produced by stamping, and the local stop in the pressure medium supply groove is provided as a material crossbar remaining after the stamping.

3. Device according to claim 2, wherein the bypass for the local stop in the pressure medium supply groove is arranged in the side surface of the rotor hub of the vane rotor facing away from the camshaft and is provided as an elongated hole-like recess, which can be formed in a powder metallurgical production of the rotor hub of the vane rotor without further tools.

* * * * *